US006338550B1

(12) United States Patent
Amano et al.

(10) Patent No.: US 6,338,550 B1
(45) Date of Patent: Jan. 15, 2002

(54) INKJET PRINTING HEAD WITH OVAL FLEXIBLE CABLE CONFIGURED TO BE RECEIVED WITHIN OVAL HOLLOW PORTION

(75) Inventors: Toshio Amano; Hisayoshi Fujimoto; Yasushi Ema; Yasuhisa Fujii; Nobuhisa Ishida, all of Kyoto (JP)

(73) Assignee: Rohm, Co., Ltd., Kyoto (JP)

( * ) Notice: Subject to any disclaimer, the term of this patent is extended or adjusted under 35 U.S.C. 154(b) by 940 days.

(21) Appl. No.: 08/974,108

(22) Filed: Nov. 19, 1997

Related U.S. Application Data

(63) Continuation of application No. 08/388,831, filed on Feb. 15, 1995, now abandoned.

(30) Foreign Application Priority Data

| | | |
|---|---|---|
| Feb. 15, 1994 | (JP) | 6-018135 |
| Mar. 1, 1994 | (JP) | 6-031614 |
| Mar. 1, 1994 | (JP) | 6-031615 |
| Mar. 1, 1994 | (JP) | 6-031616 |

(51) Int. Cl.[7] ..... B41J 2/045
(52) U.S. Cl. ..... 347/71
(58) Field of Search ..... 347/40, 68, 70, 347/71, 87

(56) References Cited

U.S. PATENT DOCUMENTS

| | | | | |
|---|---|---|---|---|
| 4,131,899 A | | 12/1978 | Christou | 347/71 |
| 4,339,763 A | | 7/1982 | Kyser et al. | 347/71 |
| 4,521,788 A | | 6/1985 | Kimura et al. | 347/68 |
| 4,617,581 A | * | 10/1986 | Koto et al. | 347/71 |
| 4,771,295 A | * | 9/1988 | Baker et al. | 347/87 |
| 5,574,490 A | * | 11/1996 | Gragg et al. | 347/87 |
| 5,581,288 A | * | 12/1996 | Shimizu et al. | 347/87 |

FOREIGN PATENT DOCUMENTS

| | | | |
|---|---|---|---|
| EP | 0 486 256 A2 | | 5/1992 |
| EP | 0 518 380 A2 | | 6/1992 |
| JP | 4-122441 | * | 5/1989 |
| JP | 3-175044 | * | 7/1991 |
| JP | 5-246044 | * | 12/1993 |
| JP | 6-79870 | * | 3/1994 |
| WO | WO 88/07935 | | 10/1988 |

* cited by examiner

*Primary Examiner*—Benjamin R. Fuller
*Assistant Examiner*—C. Dickens
(74) *Attorney, Agent, or Firm*—Fish & Richardson P.C.

(57) ABSTRACT

An inkjet printing head which is capable of being assembled efficiently and easily. In the inkjet printing head, a main frame has a hollow portion for receiving a flexible cable therein, and a sub-frame has a rimmed window for receiving a flexible member. The main frame and sub-frame are combined such that the flexible cable and flexible member are sandwiched therebetween. The hollow portion of the main frame, the flexible cable and the rimmed window of the sub-frame have the same shape so that these members can be reliably positioned with respect to one another. Electrodes on the flexible cable are pressed, with a uniform pressure, to piezoelectric elements of a head assembly attached to the main frame.

20 Claims, 10 Drawing Sheets

INKJET PRINTING HEAD WITH OVAL FLEXIBLE CABLE CONFIGURED TO BE RECEIVED WITHIN OVAL HOLLOW PORTION

This application is a continuation of U.S. application Ser. No. 08/388,831, filed Feb. 15, 1995, now abandoned.

BACKGROUND OF THE INVENTION

1. Field of the Invention

The present invention relates to an improved inkjet printing head applicable to a printer, a facsimile machine, a plotter and so on.

2. Description of the Related Art

There are known inkjet printing methods in which printing is performed by jetting ink from nozzles onto a recording medium such as paper without bringing a printing head into contact with the recording medium. One typical example of such a method is the drop-on-demand type inkjet printing method, in which ink drops are produced only when needed. With a printing head operating according to this method, a voltage is applied to a piezoelectric element, which varies the volume of a pressure chamber housing ink. Then, ink is caused to fly at the paper via a nozzle in communication with the pressure chamber. Such a printing head mainly comprises a head plate including a plurality of pressure chambers, a diaphragm, and a plurality of piezoelectric elements.

The pressure chambers and piezoelectric elements are arranged in various ways on the head plate in accordance with printing head specifications. For instance, a printing head of a line printer includes pressure chambers and piezoelectric elements which are arranged in a line so that nozzles are aligned along a printing line. With a serial printer, a printing head includes pressure chambers and piezoelectric elements which are radially arranged in a space extending through 180° or more.

In the inkjet printing head, a diaphragm in the shape of a thin film is attached onto a head plate carrying a plurality of pressure chambers thereon. A plurality of piezoelectric elements are arranged on the diaphragm such that they respectively correspond to the pressure chambers. The piezoelectric elements are respectively actuated by a voltage applied thereto, thereby causing the corresponding parts of the diaphragm to shudder. The shuddering of the diaphragm is transmitted to pressure chambers, thereby flexing them. Then, ink is jetted from nozzles in communication with the pressure chambers. Conversely, when the voltage application is stopped, the diaphragm restores, sucking ink from an ink delivery area, and preparing for a subsequent ink jetting operation. Specifically, the respective piezoelectric elements are actuated in response to printing data supplied from an external source, and vary the volume of necessary pressure chambers. According to the varied volume, the nozzles jet a desired amount of ink onto a recording medium so as to print an image thereon.

The foregoing inkjet printing head comprises a head assembly, a cable, an ink reservoir, and an ink pipe. The head assembly includes a head plate, a diaphragm, and a plurality of piezoelectric elements. The head plate carries a plurality of pressure chambers and nozzles disposed thereon. The cable includes a group of electrodes respectively applying a voltage to their associated piezoelectric elements, and 49 control wires (i.e. at least 48 signal wires and one grounding wire when an inkjet printing head has 48 piezoelectric elements). Ink is supplied to the head assembly via the ink pipe from the ink reservoir. Particularly, it is extremely difficult to precisely contact piezoelectric elements with their corresponding electrodes and connect the ink pipe with them so as to prevent ink leakage when assembling a printing head. Therefore, there is a problem that the printing head takes time to be assembled, and that the cable including the control wires is difficult to handle. This means that the printing head cannot be assembled efficiently.

SUMMARY OF THE INVENTION

The present invention is aimed at overcoming the foregoing problems of the related art, and providing an inkjet printing head which can be assembled efficiently.

According to a first aspect of the invention, there is provided an inkjet printing head comprising: a head assembly which includes a plurality of pressure chambers, each pressure chamber having a nozzle at one end and an ink inlet at the other end thereof, a plate defining an ink conduit in communication with the ink inlets, a diaphragm disposed over the pressure chambers, and a plurality of piezoelectric elements attached to one surface of the diaphragm in such a manner as to individually correspond to the pressure chambers, each piezoelectric element making the diaphragm shudder and varying a capacity of each pressure chamber so as to introduce ink into the pressure chamber and to jet ink via the nozzle; a main frame having a hollow portion at a center thereof and supporting the head assembly on one surface thereof; a flexible cable including a group of electrodes for applying a drive voltage to the piezoelectric elements; a flexible member attached to the other surface of the main frame, the flexible member keeping the piezoelectric elements and the flexible cable in mutual contact via the hollow portion of the main frame, and preventing the flexible cable from resonating due to shudders of the piezoelectric elements; and a sub-frame fixing the flexible cable and the flexible member to the main frame with pressure.

In this arrangement, the flexible cable and the flexible member are sandwiched between the main frame and sub-frame, so that it is possible to uniformly and reliably press the electrodes toward their associated piezoelectric elements via the flexible member.

Therefore, it is possible to prevent the flexible cable from resonating when the piezoelectric elements are actuated.

The main frame includes a recess for receiving the head assembly. The hollow portion of the main frame is shaped similarly to the flexible cable so to house the flexible cable therein. Thus, the main frame, head assembly and flexible cable are precisely and easily positioned with respect to one another.

The nozzles are inclined with respect to a printing line by a predetermined angle on the head assembly, both the hollow portion of the main frame and the flexible cable are oval in the shape, and the flexible cable is housed in the hollow portion. This enables not only a printing density to be improved without narrowing a pitch between the nozzles but also assures precise, reliable and easy positioning of the main frame, head assembly and flexible cable.

The sub-frame has a rimmed window capable of fitting into the hollow portion of the main frame, and the rimmed window supports the flexible member. Thus, the flexible cable and the flexible member are positioned easily and precisely with respect to each other. Further, it is possible to contact the flexible cable to the piezoelectric elements with a uniform pressure. Still further, the inkjet printing head can be automatically assembled by using a part feeder since no strict positioning of the components is necessary.

In accordance with a second aspect of the invention, there is provided an inkjet printing head comprising: a head assembly including a plurality of pressure chambers, each pressure chamber having a nozzle at one end and an ink inlet at the other end thereof, a plate defining an ink conduit in communication with the ink inlets, a diaphragm disposed over the pressure chambers, and a plurality of piezoelectric elements attached to one surface of the diaphragm in such a manner as to individually correspond to the pressure chambers, each piezoelectric element making the diaphragm shudder and varying a capacity of each pressure chamber so as to introduce ink into the pressure chambers and to jet ink via the nozzle; a main frame having a hollow portion at a center thereof and supporting the head assembly on one surface thereof; a flexible cable including groups of electrodes for applying a drive voltage to the piezoelectric elements; a flexible member attached to the other surface of the main frame, the flexible member keeping the piezoelectric elements and the flexible cable in mutual contact via the hollow portion of the main frame, and preventing the flexible cable from resonating due to shudders of the piezoelectric elements; and a sub-frame fixing the flexible cable and the flexible member to the main frame with pressure. The diaphragm includes an ink port for supplying ink to the ink conduit, and an ink pipe in communication with an ink reservoir is disposed close to the ink port.

In this arrangement, the ink pipe in communication with the ink reservoir is directly connected to the ink port.

Since no ink is in direct contact with the main frame, it is possible to protect the main frame against erosion caused by ink. In other words, since the nozzles are not blocked by metal or resin components in the main frame, the original quality of ink can be reliably maintained without color change.

Further, the ink pipe can be directly and intimately connected to the ink port, so that it is possible to supply ink without any leakage.

According to a third aspect of the invention, there is provided an inkjet printing head comprising: a head assembly, the head assembly including: a plurality of pressure chambers, each pressure chamber having a nozzle at one end and an ink inlet at the other end thereof; a plate defining an ink conduit in communication with the ink inlets; a diaphragm disposed over the pressure chambers; and a plurality of piezoelectric elements attached to one surface of the diaphragm in such a manner as to individually correspond to the pressure chambers, each piezoelectric element making the diaphragm shudder and varying a capacity of each pressure chamber so as to introduce ink into the pressure chamber and jet ink via the nozzle; a main frame having a hollow portion at a center thereof and supporting the head assembly on one surface thereof; a flexible cable including a group of electrodes for applying a drive voltage to the piezoelectric elements; a flexible member attached to the other surface of the main frame, the flexible member keeping the piezoelectric elements and the flexible cable in mutual contact via the hollow portion of the main frame, and preventing the flexible cable from resonating due to shudders of the piezoelectric elements; and a sub-frame fixing the flexible cable and the flexible member to the main frame with pressure. The diaphragm is smaller than the ink conduit plate so as to have a beginning of the ink conduit exposed from the diaphragm and form an ink port, and the ink pipe in communication with the ink port is positioned close to the beginning of the ink conduit.

The ink pipe in communication with the ink reservoir is directly connected to the ink port, so that ink does not come into contact with the main frame.

Further, the ink port can be easily formed without specifically modifying the diaphragm or ink conduit plate. This will lead to reduction of the manufacturing cost of the inkjet printing head.

The beginning of the ink conduit is joined to the ink pipe via flexible packing so as to seal a joined portion.

A curing resin is applied to a step portion between the ink conduit plate and the diaphragm so as to form a slope thereon, which reliably and easily connects the ink pipe.

Further, the curing resin is applied so as to be banked against a peripheral area of the beginning of the ink port. This enables the ink pipe to be sealed reliably.

When the curing resin is applied so as to be banked around the beginning of the ink conduit, the joined portion of the ink pipe can be reliably sealed.

Further, a filter is closely attached to the ink port using the curing resin so as to filter impurities in the ink. The filter is integral with the joined area of the ink pipe, which can reduce the number of components used, and assures reliable connection of the ink pipe without ink leakage.

In a fourth aspect of the invention, there is provided an inkjet printing head comprising: a head assembly, the head assembly including: a plurality of pressure chambers, each pressure chamber having a nozzle at one end and an ink inlet at the other end thereof; a plate defining an ink conduit in communication with the ink inlets; a diaphragm disposed over the pressure chambers; and a plurality of piezoelectric elements attached to one surface of the diaphragm in such a manner as to individually correspond to the pressure chambers, each piezoelectric element making the diaphragm shudder and varying a capacity of each pressure chamber so as to introduce ink into the pressure chambers and to Jet ink via the nozzle; a main frame having a hollow portion at a center thereof and supporting the head assembly on one surface thereof; a flexible cable including a group of electrodes for applying a drive voltage to the piezoelectric elements; a flexible member attached to the other surface of the main frame, the flexible member keeping the piezoelectric elements and the flexible cable in mutual contact via the hollow portion of the main frame, and preventing the flexible cable from resonating due to shudders of the piezoelectric elements; a sub-frame fixing the flexible cable and the flexible member to the main frame with pressure; and a driver IC attached on the flexible cable so as to perform central control of the piezoelectric elements.

In this arrangement, only control wires for controlling the driver IC extend out from the inkjet printing head.

Since a width of a bundle of the control wires can be reduced without thinning respective control wires, the control wires are durable. The reduced width of the control wire bundle can decrease a space for attaching the inkjet printing head to a printer body. This is advantageous for making the printer compact.

Such an inkjet printing head can be easily handled and efficiently attached to the printer body.

The flexible cable carrying the driver IC is sandwiched between the main frame and sub-frame, which allows the inkjet printing head to be efficiently assembled.

An external connection terminal is attached to one end of the flexible cable so as to receive a signal actuating the driver IC. This enables the printer body and the inkjet printing head to be fabricated separately, and to be joined at a later stage. The inkjet printing head becomes easy to handle and to connect to the printer body. Further, a faulty inkjet printing head can be easily replaced with a new one.

Since the driver IC is positioned on a recess of the rear surface of the main frame, the main frame and the sub-frame can be brought into close contact with each other. Thus, the electrodes on the flexible cable can be uniformly pressed to the piezoelectric elements on the main frame.

Alternatively, when the driver IC is positioned on a recess on a surface of the sub-frame where it is pressed to the main frame, the main frame and the sub-frame can be brought into close contact so as to sandwich the flexible cable carrying the driver IC. Therefore, the electrodes on the flexible can be pressed to the piezoelectric elements on the main frame with uniform force.

BRIEF DESCRIPTION OF THE INVENTION

Identical parts are assigned identical reference numerals throughout the drawing figures.

DESCRIPTION OF THE PREFERRED EMBODIMENTS

First Embodiment

Figure 1:
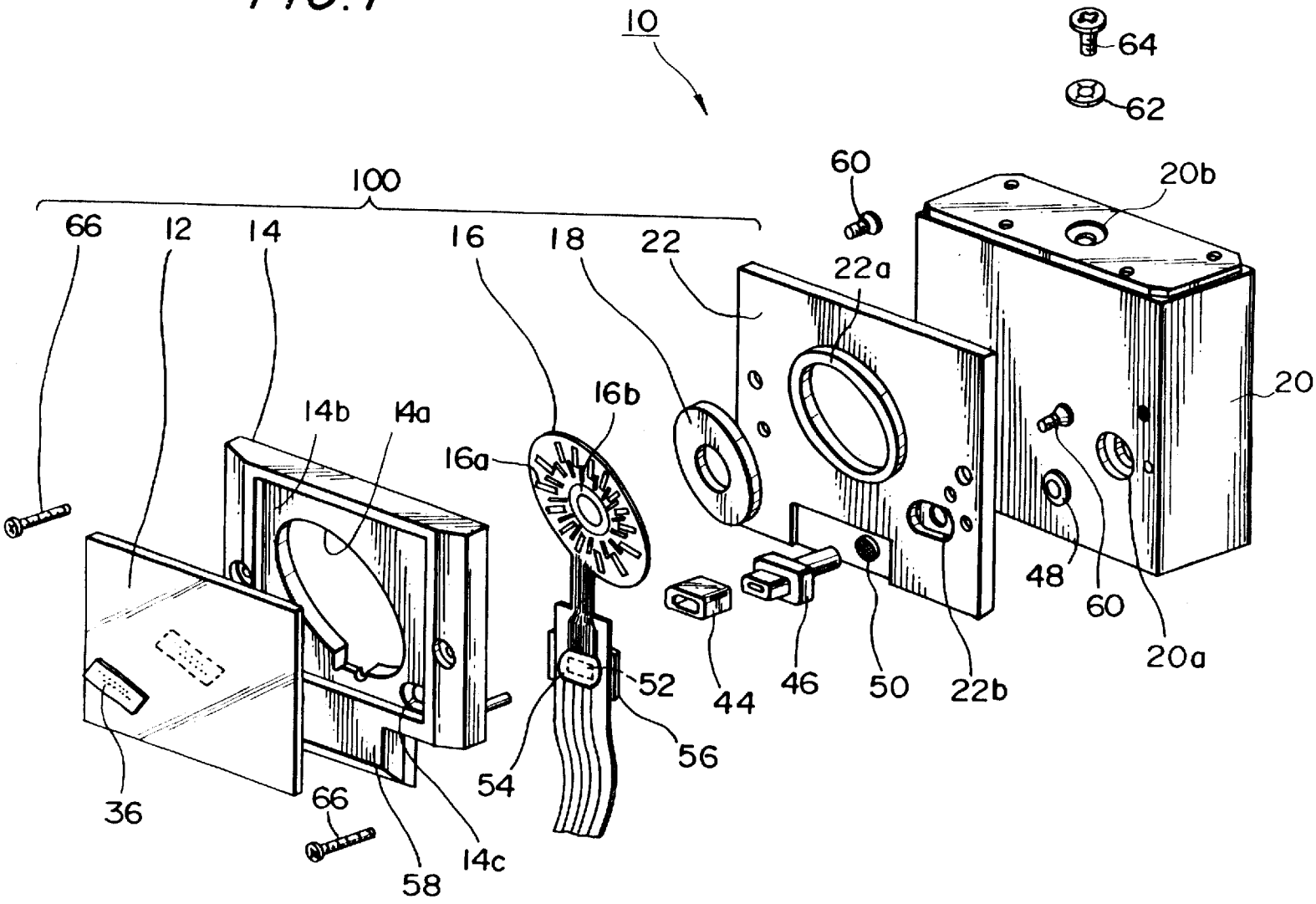
FIG. 1 is an exploded perspective view showing an inkjet printing head according to a first embodiment of the invention.

The invention will be described with reference to a first embodiment shown in the drawings. It is assumed that the present invention is applied to an inkjet printing head for a serial type printer.

Referring to FIG. 1, the inkjet printing head 10 comprises a head assembly 12, a main frame 14 made from resins or metal, a flexible cable 16, a flexible member 18, and an ink reservoir 20 feeding ink to the head assembly 12. The head assembly 12 includes an ink conduit plate carrying pressure chambers, a diaphragm and a plurality of piezoelectric elements, all of which will be described later in detail. The flexible cable 16 applies a voltage to the piezoelectric elements. The flexible member 18 prevents the flexible cable 16 from resonating when the piezoelectric elements are actuated.

A first feature of the first embodiment is that the flexible cable 16 and the flexible member 18 are sandwiched and fixed between the rear surface of the main frame 14 and a sub-frame 22. Both the main frame 14 and sub-frame 22 are made of hard resins or metal such as aluminum. A second feature is that a hollow portion 14*a* of the main frame 14 is shaped similarly to the flexible cable 16, e.g. oval, so as to receive the flexible cable 16 therein. A further feature is that the sub-frame 22 has a rimmed window 22*a,* which can be fitted into the hollow portion 14*a* of the main frame 14. The rimmed window 22*a* receives the flexible member 18 therein. In other words, the flexible member 18 is positioned with respect to the main frame 14 and the flexible cable 16 via the rimmed window 22*a* of the sub-frame 22. Further, the flexible member 18 protrudes somewhat from the rimmed window 22*a,* thereby pressing the flexible cable 16 closely to the head assembly 12.

Figure 2:
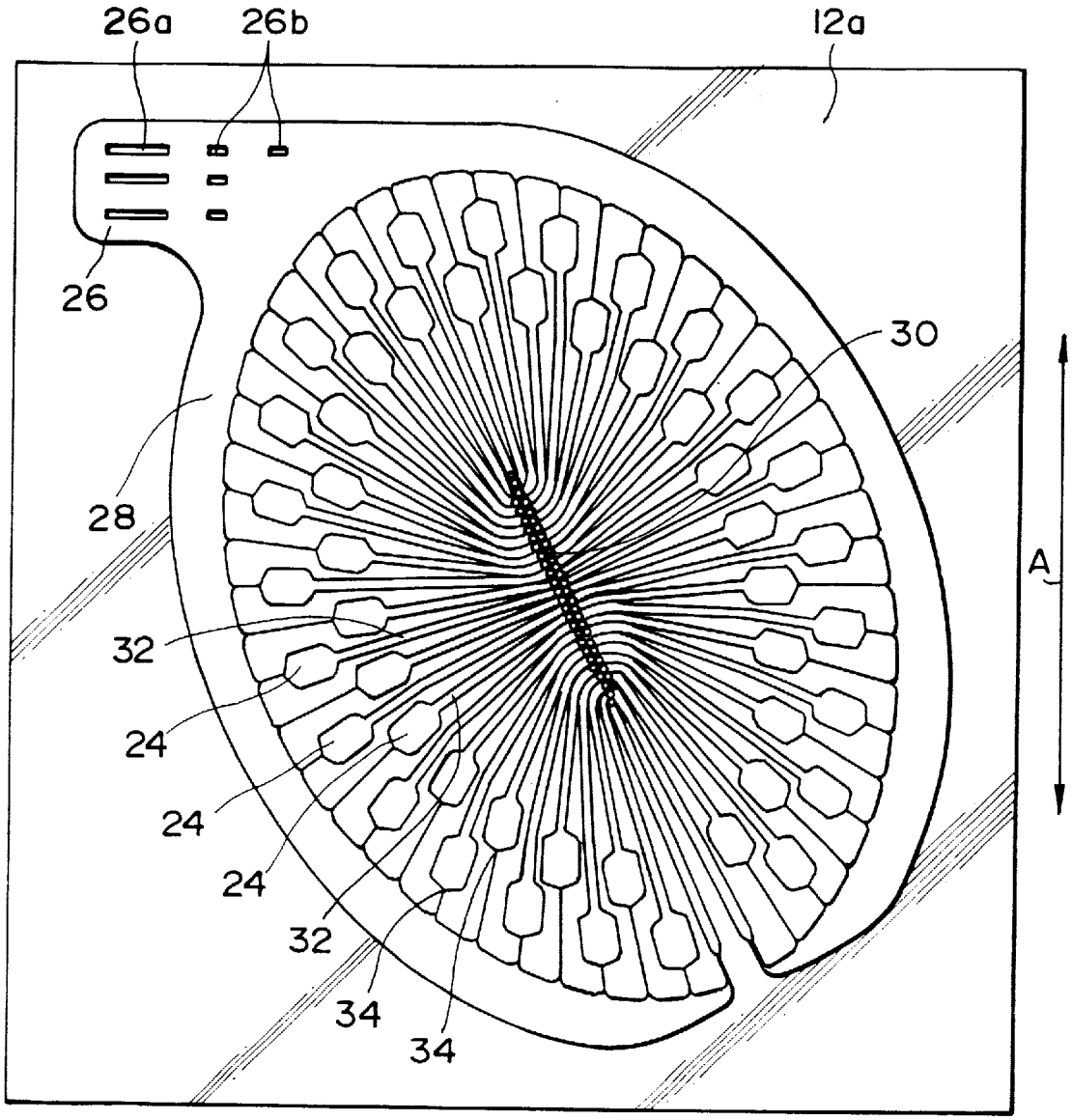
FIG. 2 is a front view of an ink conduit plate for a head assembly in the first embodiment.

As shown in FIG. 2, in the head assembly 12 attached to the main frame 14, the ink conduit plate 12*a* is made from a material such as glass, and has an ink conduit 28 which is in communication with the pressure chambers 24 and is formed by a process such as etching on one surface (i.e. the rear side of the plane shown in FIG. 1). The ink conduit 28 feeds ink to a plurality of pressure chambers 24 (e.g. 48 pressure chambers 24 in FIG. 2) from the ink reservoir 20 via an ink introducing portion 26. Each of the pressure chambers 24 has a nozzle 30 at one end (toward the center of the ink conduit plate 12*a*), and an ink inlet 34 at the other end (along the ink conduit 28). The nozzles 30 are open on the rear side of the plane shown in FIG. 2. The ink inlets 34 are thinner than supply channels 32 so as to reduce a resistance which is caused when ink is jetted from the pressure chambers 24, thereby preventing ink from flowing in a reverse direction.

The inkjet printing head 10 including the head assembly 12 is actuated by a drive mechanism, not shown, so as to reciprocate in a direction A (i.e. along a printing line A) as shown in FIG. 2, thereby printing an image. In this case, the nozzles 30 are inclined by a predetermined angle, e.g. 30°, with respect to the printing line direction A, so that a printing pitch can be reduced without reducing a pitch for arranging the nozzles 30. This assures dot printing with very high density.

In this example, a plurality of nozzles 30 are provided on the ink conduit plate 12*a*. Alternatively, a nozzle plate 36 having a plurality of openings serving as the nozzles 30 may be attached on a front surface of the head assembly 12 shown in FIG. 1. The openings of the nozzle plate 36 have a smaller diameter than the diameter of the nozzles 30. Thus, the nozzle plate 36 is effective for increasing an ink jetting pressure, thereby improving the quality of printed images.

Referring to FIG. 2, the pressure chambers 24 are effectively arranged in a staggered manner in two rows so that ink feeders can be effectively positioned in a limited space.

The ink introduction portion 26 may have support members 26*a* and 26*b* so as to support a diaphragm 38 (to be described later). The support members 26*a* and 26*b* are effective to prevent non-smooth flow of ink around the ink introducing portion 26 due to the ink conduit 28 being pressed by the diaphragm 38.

Figure 3:
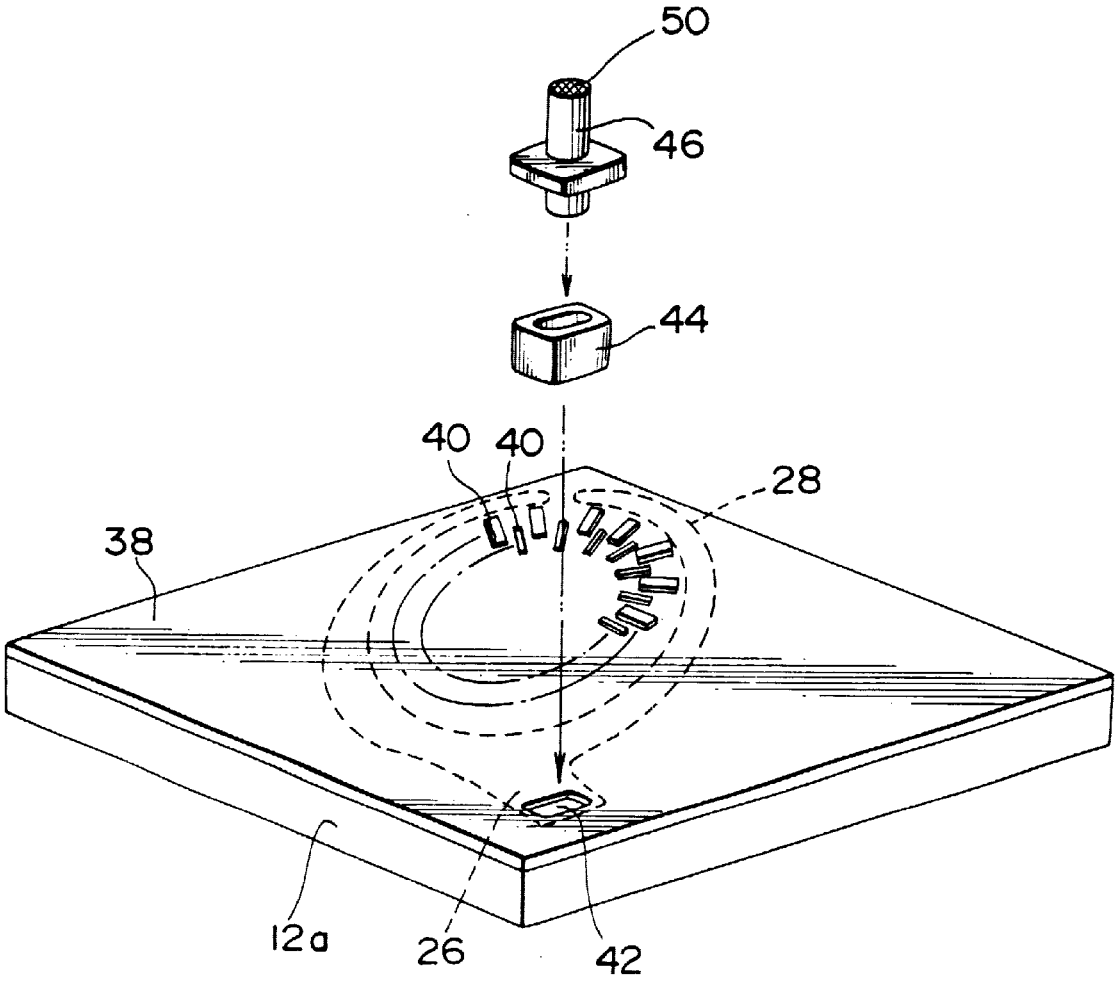
FIG. 3 is a view showing how to attach an ink pipe to the head assembly in which the ink conduit plate carries a diaphragm and piezoelectric elements thereon.

The diaphragm 38 is attached to the front surface of the ink conduit plate 12*a* (i.e. opposite to the surface where the nozzles 30 are located) as shown in FIG. 3. The diaphragm 38 is a plate such as glass, is approximately 50 $\mu$m thick, and has a plurality of piezoelectric elements 40 on its upper surface. The piezoelectric elements 40 correspond, on a one-to-one basis, to the pressure chambers 24 (FIG. 2) on the ink conduit plate 12*a*. When a voltage is applied to actuate a particular piezoelectric element 40 in response to printing data from an external source, the piezoelectric element 40 causes the diaphragm 38 to locally shudder at a position associated therewith. Then, the shudder of the diaphragm 38 is transmitted to a corresponding pressure chamber 24. The volume of the pressure chamber 24 is reduced, thereby jetting ink therefrom onto the recording medium. Conversely, when the voltage application is stopped, the diaphragm 38 restores to its original state, sucks ink from the ink conduit 28, and prepares for a subsequent ink jetting operation.

Referring to FIG. 3 (in which the ink conduit 28 is shown by a broken line), the diaphragm 38 includes an ink port 42 at the ink introducing portion 26 from which the ink conduit 28 extends. The ink port 42 is made using excimer laser or sand blasting. A sealing member 44 and an ink pipe 46 are fitted into the ink port 42 and are sandwiched between the main frame 14 and the sub-frame 22. The ink pipe 46 is connected, at one end thereof, to an outlet 20*a* of the ink reservoir 20 via a sealant such as an O-ring 48. Further, the ink pipe 46 has a filter 50 at the other end thereof (i.e. where the pipe 46 is connected to the ink reservoir 20) so as to prevent introduction of impurities into the head assembly 12. The sealing member 44 is made from a material such as silicon rubber. Therefore, the ink pipe 46 can be intimately fitted and fixed in the ink port 42 with ease, thereby preventing ink leakage. Further, ink can be fed to the head assembly 12 from the ink reservoir 20 via the ink pipe 46 directly connected to the ink port 42. Since no ink comes into contact with the main frame 14, not only can the main frame 14 be protected against erosion but also ink can maintain its original quality.

Figure 4:
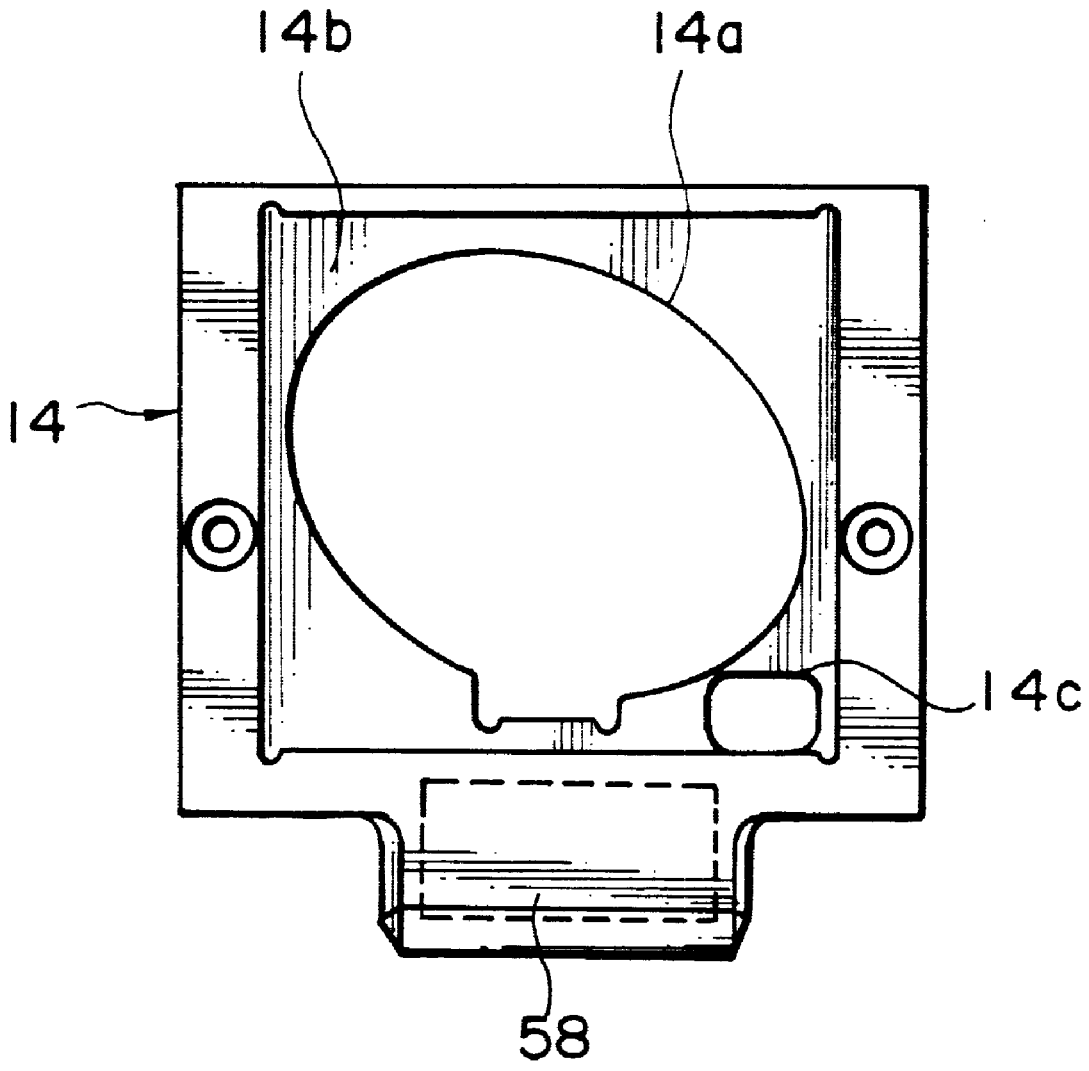
FIG. 4 is a front view of a main frame for the inkjet printing head shown in FIG. 1.

As shown in FIG. 4, the main frame 14 is made from a material such as resin or aluminum, and has a substantially oval hollow portion 14*a*. The head assembly 12 is attached to the main frame 14 by a UV type adhesive, an anaerobic, or the like. Referring to FIGS. 1 and 4, the main frame 14 has a shallow recess 14*b* to receive the head assembly 12 therein. In other words, the hollow portion 14*a* is positioned substantially at the center of the shallow recess 14*b*. When the head assembly 12 is put into the shallow recess 14*b*, the piezoelectric elements 40 of the head assembly 12 are exposed on the rear surface of the main frame 14 via the hollow portion 14*a*. A space still remains in the hollow portion 14*a* in which the flexible cable 16 (to be described later) is housed. This structure is effective for preventing vibrations which may be caused when the head assembly 12 performs the ink jetting operation.

The flexible cable 16 carries a number of electrodes 16*a* and circularly arranged COM electrodes 16*b* as shown in FIG. 1. The electrodes 16*a* apply a voltage to the piezoelectric elements 40 (FIG. 3) of the head assembly 12. The electrodes 16*a* and the circular COM electrode 16*b* are printed on the flexible cable 16 in the same pattern as that of the piezoelectric elements 40 (shown in FIG. 1). The oval flexible cable 16 is precisely fitted into the oval hollow portion 14*a* from the rear side of the main frame 14. Thus, the electrodes 16*a* are easily positioned in such a manner as to precisely correspond to the piezoelectric elements 40 on a one-to-one basis.

A conductive film made from a material such as indium tin oxide (ITO) is applied on the surface of the diaphragm 38 where the piezoelectric elements 40 are arranged, serving as a COM electrode for the diaphragm 38. Thus, the voltage to actuate the piezoelectric elements 40 can be easily applied by arranging the COM electrode 16*b* at the center of the flexible cable 16 and arranging the electrodes 16*a* around the COM electrode 16*b*.

Figure 5:
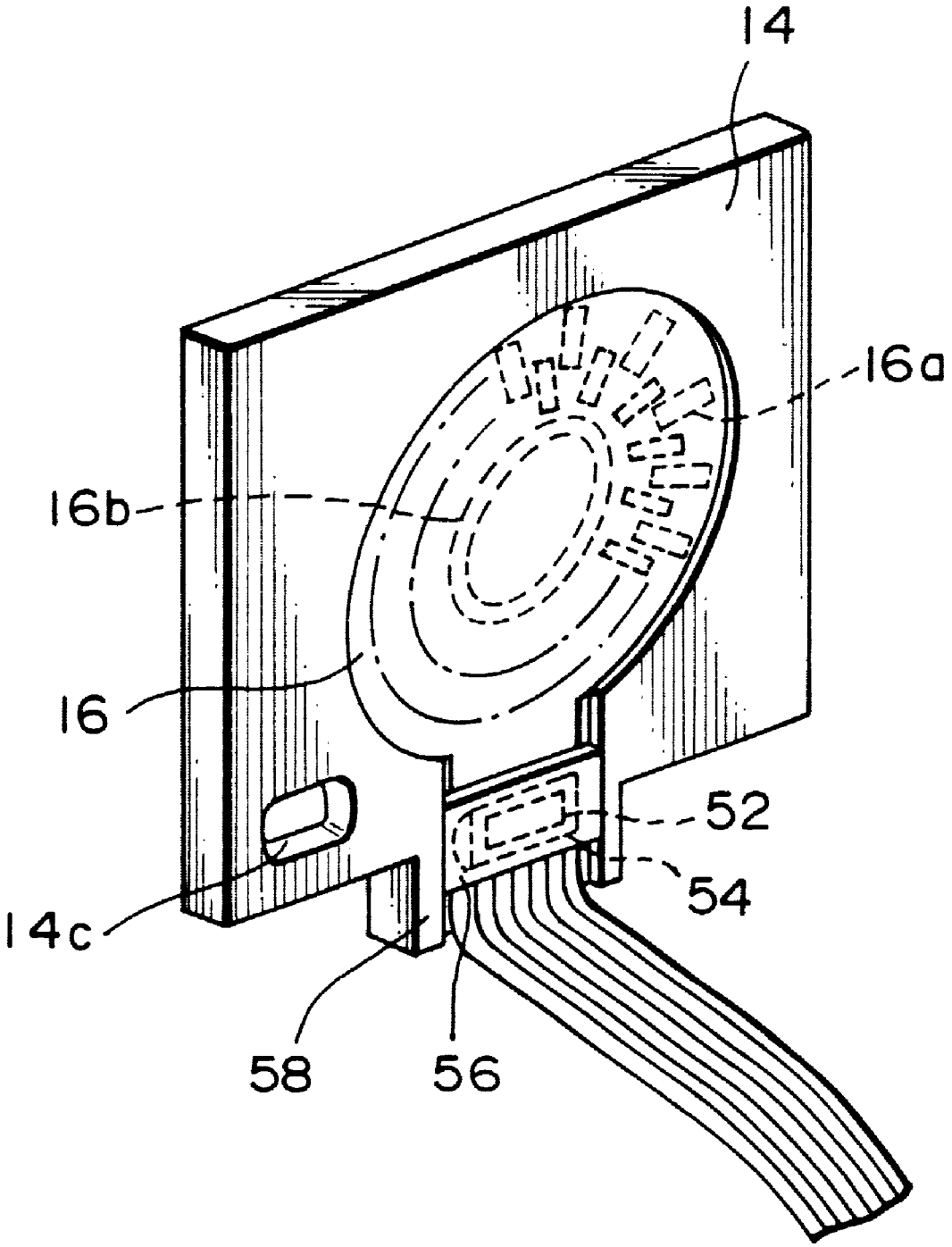
FIG. 5 shows a manner in which a flexible cable is attached to the main frame of FIG. 4.

Referring to FIG. 5, a driver IC 52 is attached to the flexible cable 16 so as to perform central control of the piezoelectric elements 40 (i.e. there are 48 piezoelectric elements in this embodiment). The driver IC 52 includes a data input terminal, a clock input terminal, a strobe terminal, an input terminal inputting a piezoelectric element actuating wave, a power supply terminal, a grounding terminal and so on. Data concerning the piezoelectric elements 40 are sequentially applied to a shift register of the driver IC via the data input terminal. The data in the shift register are shifted in response to signals arriving at the clock terminal. In response to signals input in the strobe input terminal, the shift register provides the data to the piezoelectric elements 40. Further, the driver IC 52 may also include terminals such as a terminal receiving information on an empty state of the ink reservoir 20 (shown in FIG. 1), and an input terminal receiving data concerning an intermediate actuation wave to gradually control the operation of the piezoelectric elements 40 and to stabilize an amount of ink to be jetted.

It is therefore possible to thin down the flexible cable 16 extending from the inkjet printing head 10 via the driver IC 52. This is because the cable 16 can have only a few control wires (e.g. the data input terminal, clock input terminal, strobe input terminal, actuation wave input terminal, power supply terminal, and grounding terminal, and also empty ink reservoir information input terminal and intermediate actuation wave terminal if necessary). In other words, the flexible cable 16 can be disposed and fixed in a reduced space of the inkjet printing head 10. This means that the printer body where the inkjet printing head 10 can be also reduced in size.

Further, even when the inkjet printing head is a movable type or when the flexible cable 16 is arranged in a complicated manner, the flexible cable 16 can be thinned down without reducing a pitch of a control wire pattern. Thus, the flexible cable 16 can be easily disposed in the reduced space without adversely affecting the durability of the control wire pattern.

The flexible cable 16 carrying the driver IC 52 is protected by a resin cover 54 on the front surface thereof, and is covered on the rear surface by a support 56 (made from a material such as resin) so as to reliably fix the driver IC 52 on the flexible cable 16. As shown in FIG. 5, a recess 58 is formed on the rear surface of the main frame 14 (i.e. on the side where the main frame 14 is in contact with the sub-frame 22 shown in FIG. 1). The driver IC 52 is received in the recess 58, thereby enhancing the close contact of the main frame 14 with the sub-frame 22 when the flexible cable 16 is sandwiched between them.

The sub-frame 22 made from resin or metal such as aluminum is positioned behind the main frame 14. The sub-frame 22 has an oval rimmed window 22*a* which is insertable into the hollow portion 14*a* of the main frame 14. The flexible member 18 is fitted into the rimmed window 22*a*. The flexible member 18 is made from a material such as sponge or rubber, and is substantially annular. The flexible member 18 is preferably thick enough to slightly project from the rimmed window 22*a* when fitted therein.

Since the hollow portion 14*a* and the rimmed window 22*a* are the same in shape, both the main frame 14 and the sub-frame 22 can be precisely and easily combined with the rimmed window 22*a* received in the hollow portion 14*a*. The flexible member 18 slightly projecting from the rimmed window 22*a* pushes the flexible cable 16 toward the piezoelectric elements 40 with a uniform pressure. Thus, the electrodes 16*a* and 16*b* of the flexible cable 16 can be reliably brought into contact with the piezoelectric elements 40. Further, the flexible cable 16 can be effectively protected against resonance when the piezoelectric elements 40 are actuated.

Besides the flexible cable 16 and the flexible member 18, the ink pipe 46, sealing member 44 and filter 50 are also interposed between the main frame 14 and the sub-frame 22. The ink pipe 46 provides ink to the pressure chambers 24 via the ink port 42 (of the head assembly 12) and an opening 14*c* (formed on a part of the main frame 14). The sealing member 44 prevents ink leakage and ink flow to the main frame 14. The filter 50 removes impurities which may flow into the ink conduit 28. These members are shown in FIG. 3. The main frame 14 and sub-frame 22 are fixed using small screws or an adhesive, constituting an independent head unit 100.

The sub-frame 22 has an opening 22*b,* through which the ink pipe 46 passes.

The ink reservoir 20 containing ink is located behind the sub-frame 22, and discharges a predetermined amount of ink with a predetermined pressure via an ink outlet 20*a.* The ink reservoir 20 has an opening 20*b* on the top so as to refurnish fresh ink. The opening 20*b* is usually covered by a cap 64 via an O-ring 62.

The ink pipe 46 extends from the rear surface of the sub-frame 22 of the head unit 100, and is fitted into the ink outlet 20*a* of the ink reservoir 20 via an O-ring 48. The head unit 100 and the ink reservoir 20 are combined and fixed using small screws 66 or the like.

The head unit 100 and the ink reservoir 20 not only serve as an integral unit but are also separable for replacement when either of them becomes defective.

All of the hollow opening 14*a,* flexible cable 16, flexible member 18 and rimmed window 22*a* have the same oval shape, so that the main frame 14, flexible cable 16, flexible member 18 and sub-frame 22 can be precisely and easily positioned with respect to one another. Therefore, the inkjet printing head can be automatically assembled in an assembly line using a component feeder or the like.

In the foregoing embodiment, the inkjet printing head includes the pressure chambers and piezoelectric elements which are radially arranged in two rows in an oval space of the head assembly. Alternatively, these members may be radially arranged in a single row in a circular space, or in a line.

Second Embodiment

An inkjet printing head will be described with reference to a second embodiment shown in FIG. 6.

Figure 6:
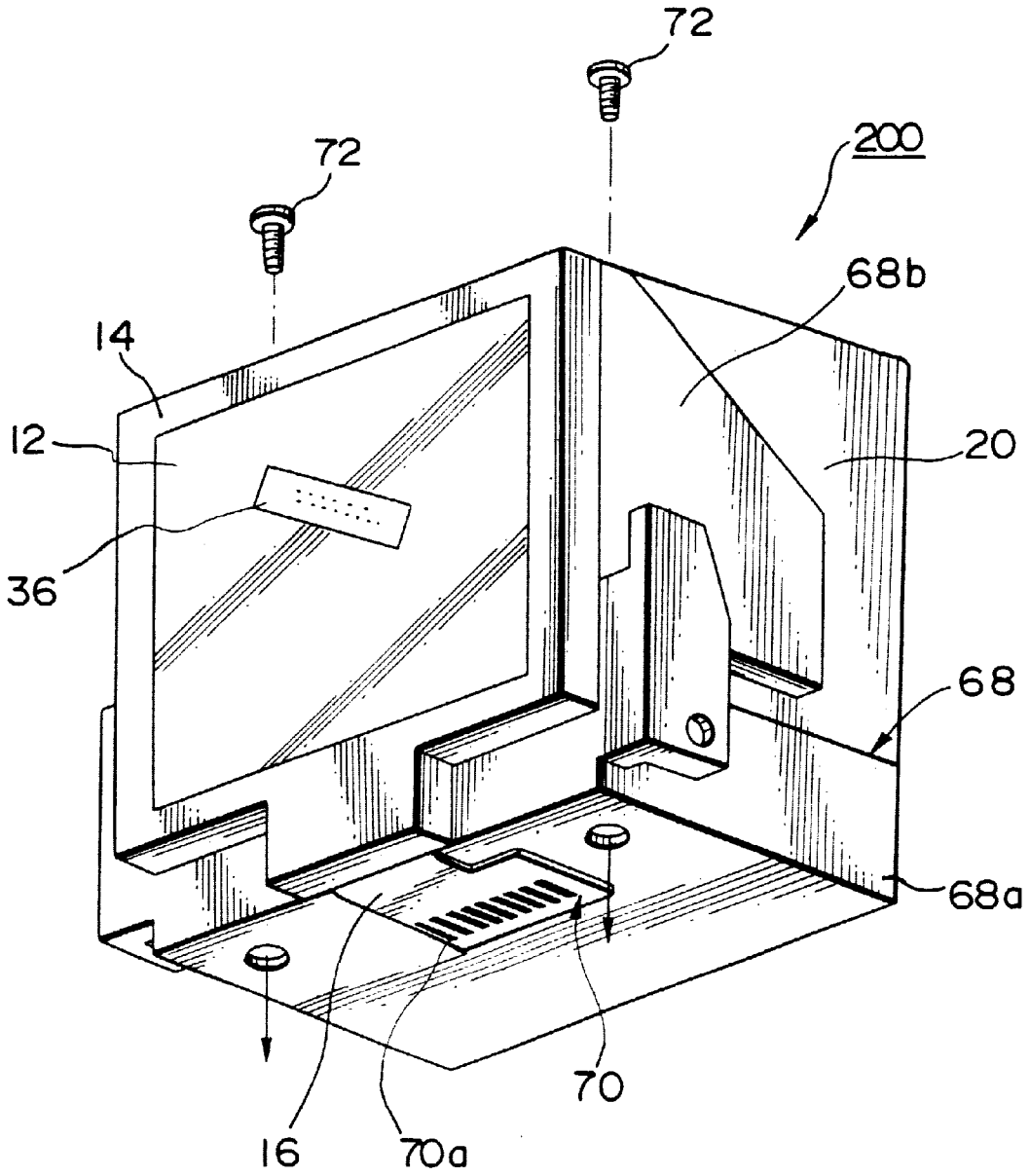
FIG. 6 is a perspective view showing an assembled state of an inkjet printing head according to a second embodiment.

Referring to FIG. 6 showing an inkjet printing head 200, a sub-frame 68 differs from the sub-frame 22, which is in the shape of a plate, and includes a base member 68*a* receiving an ink reservoir 20, a pair of side walls 68*b* holding opposite sides of the ink reservoir 20 (only one side wall is shown in FIG. 6), and a wall (not shown) between the side walls 68*b* and not only pressing a flexible member 18 (not shown) to a flexible cable 16 but also fixing the flexible cable 16. This pressing wall functions similarly to the sub-frame 22 shown in FIG. 1.

The flexible cable 16 extends downwards from the rear surface of the main frame 14 in a similar manner to that shown in FIG. 5. The downward end of the flexible cable 16 is connected to an external connection terminal 70. The external connection terminal 70 includes a plurality of terminal sections which are connected to terminals of the driver IC 52 so as to provide control signals thereto from an external source, not shown.

The flexible cable 16 extending from between the main frame 14 and the sub-frame 68 is folded at right angles with respect to the main frame 14. In this state, the external connection terminal 70 is structured such that a connector 70*a* thereof faces downward and is attached to the rear surface of the base member 68*a*. It is also acceptable to attach a nozzle plate 36 on the front surface of the head assembly 12 in a similar manner to that shown in FIG. 1.

Provision of the external connection terminal 70 allows the inkjet printing head and the printer body to be assembled in separate processes, which improves manufacturing efficiency and reduces manufacturing cost. This structure facilitates replacement of a faulty inkjet printing head or a faulty printer body.

The inkjet printing head 200 comprising the main frame 14 and the sub-frame 68 is fixed to a carriage of the printer body using small screws 72 or the like. The carriage has a connector at a position where the connector 70*a* of the external connection terminal 70 is connectable. Both of these connectors can be reliably and easily connected by attaching the inkjet printing head 200 to the carriage using small screws 72.

Since the number of control wires connected to the driver IC 52 can be reduced, the inkjet printing head and the printer body can be electrically connected in a reduced space. Thus, the printer can be reduced in size and simplified easily and reliably. Further, the ink reservoir 20 is enclosed by the sub-frame 68, so that the carriage can be stably moved during the printing operation.

Third Embodiment

Figure 7:
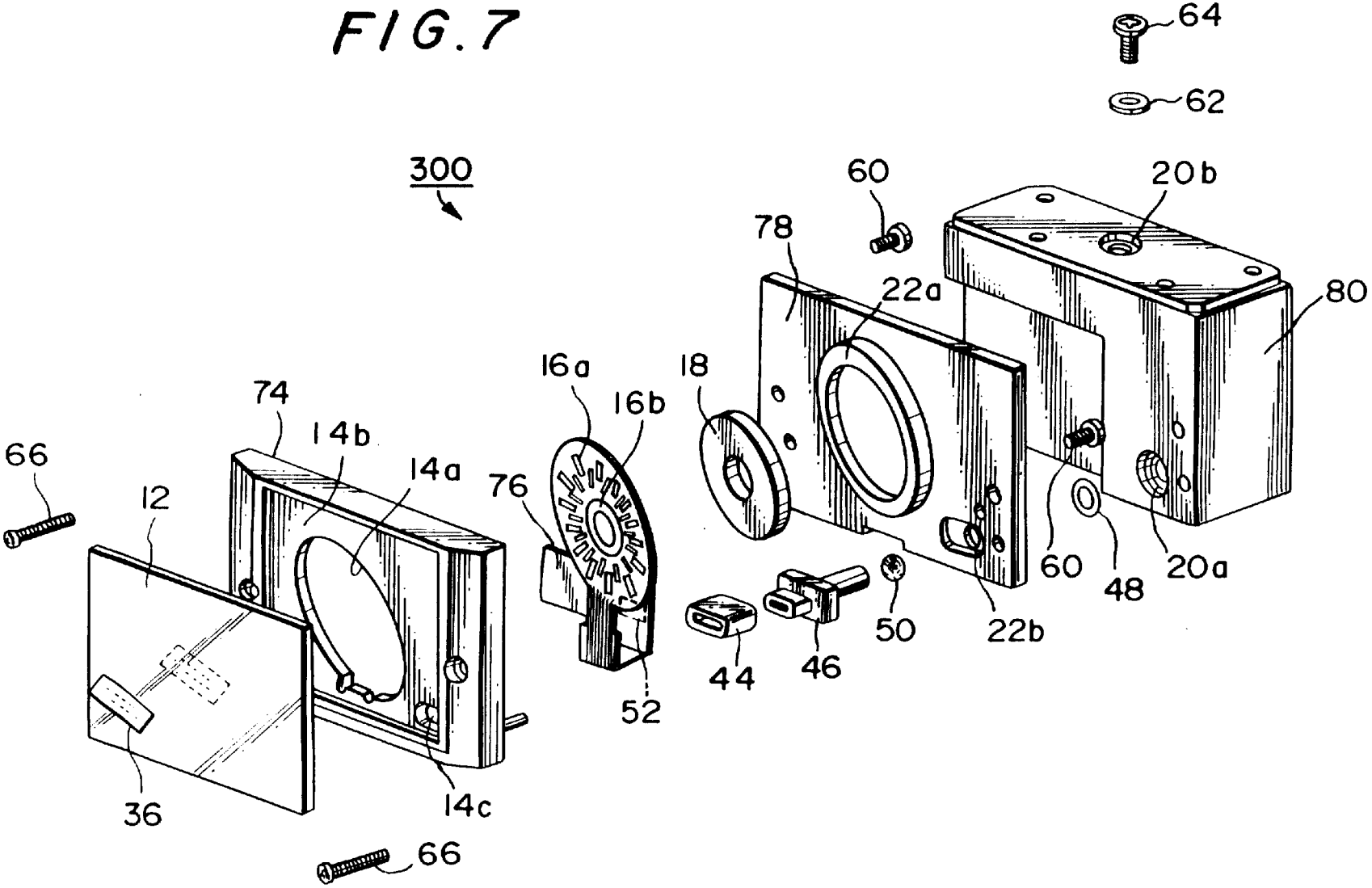
FIG. 7 is a perspective view of an inkjet printing head according to a third embodiment.

The invention will be described with reference to a third embodiment shown in FIG. 7, in which the flexible cable 76 is fixed in a different manner. In this embodiment, an inkjet printing head 300 differs from the inkjet printing head 10 (FIG. 1) with respect to the shapes of a main frame 74, a flexible cable 76, a sub-frame 78, and an ink reservoir 80. The remaining parts are similar to those of the first embodiment, are assigned identical reference numerals, and will not be described in detail.

Figure 8:
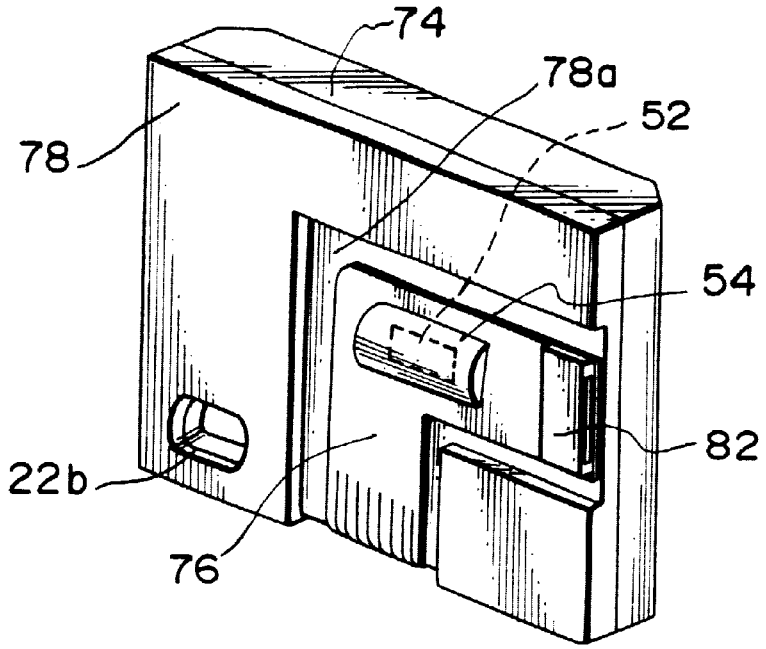
FIG. 8 is a perspective view showing how a flexible cable is fixed in the third embodiment.

The driver IC 52 is housed in the main frame 14 in the first embodiment. However, in this embodiment, the driver IC 52 is positioned on the rear surface of the sub-frame 78 in stead of the main frame 74. Specifically, control wires connected to the piezoelectric elements 40 (i.e. 48 signal wires and one grounding wire) extend downwards from between the main frame 74 and the sub-frame 78, are folded upward along the rear surface of the sub-frame 78, and are fastened there. The inkjet printing head including the main frame 74 and the sub-frame 78 is preferably fastened to the ink reservoir 80. For this purpose, a recess 78*a* is formed on the rear surface of the sub-frame 78 as shown in FIG. 8 so as to prevent the driver IC 52, and external connection terminal 82 (functions similarly to the terminal 70 shown in FIG. 6) from sticking out from the sub-frame 78. Alternatively, a recess may be made on the ink reservoir 80 so as to receive the driver IC 52 and the external connection terminal 82 of a connector type may stick out and prevent them from sticking out.

Even when the driver IC 52 is positioned on the sub-frame 78, the inkjet printing head of this embodiment can be assembled effectively and be reduced in size. This will lead to a reduced volume of the printer where the inkjet printing head is attached.

In the third embodiment, the flexible cable 16 extends from between the main frame 74 and the sub-frame 78, and is fixedly attached to the rear surface of the sub-frame 78. Alternatively, a recess is formed on the rear surface of the main frame 74-1 so as to receive the flexible cable 76-1 therein as shown in FIG. 9.

Figure 9:
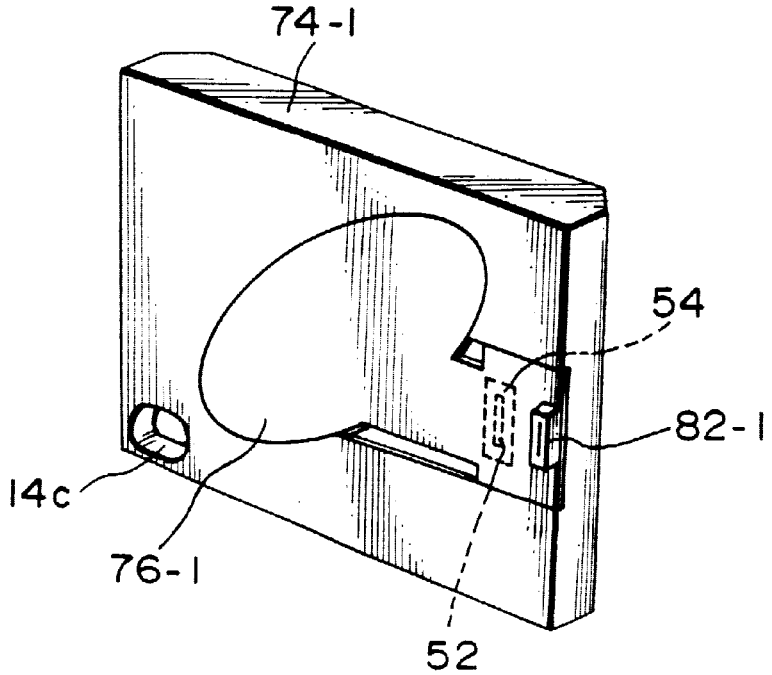
FIG. 9 is a perspective view showing how a flexible cable is fixed in an inkjet printing head in another example according to the third embodiment.

The external connection terminal may be shaped and oriented like a terminal 82-1 shown in FIG. 9. For instance, the external connection terminal may be of a connector type (box type) like the external terminals 82 and 82-1, or may be in the shape of a card as shown in FIG. 6. The external terminal can project in any direction as shown in FIGS. 8 and 9, depending upon the shape of the printer body.

The inkjet printing head of the third embodiment is described assuming that it is applied to the serial type printer, but is also applicable to a line type printer with similar advantageous results.

Further, the flexible cable extending from the inkjet printing head is connected to the external connection terminal separately at a later stage. If necessary, it is also possible to obviate the external connection terminal and make the flexible cable extendable. Such a flexible cable requires a reduced space and is durable.

Fourth Embodiment

An inkjet printing head of a fourth embodiment differs from those of the first to third embodiments in the shape of the ink port through which ink is supplied to the ink conduit from the ink reservoir.

The fourth embodiment features that a diaphragm 84 smaller than the ink conduit plate 12*a* is attached to the ink conduit plate 12*a*. Thus, only the beginning of the ink conduit 28, i.e a portion corresponding to the ink introducing portion 26, is exposed. In this arrangement, the ink pipe 46 in communication with the ink reservoir 20 can be directly connected to the ink port 86.

Thus, it is possible to prepare the ink port 86 without particularly modifying the diaphragm 84 and the ink conduit plate 12*a*.

Figure 11:
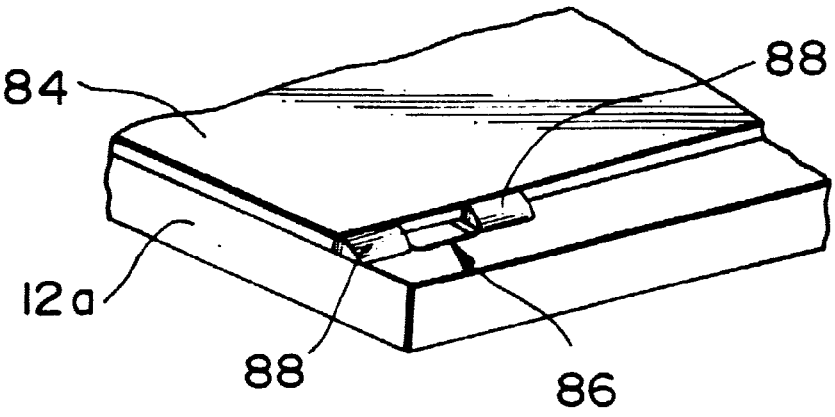
FIG. 11 shows a manner in which an ink conduit plate and a diaphragm are joined in the fourth embodiment.

There is a difference of height between the ink conduit plate 12*a* and a diaphragm 84 around the ink introducing portion 86. This difference is equal to a height of the diaphragm 84. An ink pipe 46 is connected to an ink port 86 via a sealing member 44 applied to the portion where there is the foregoing difference, thereby preventing ink leakage. In other words, the ink pipe 46 and sealing member 44 are sandwiched between the main frame 14 and sub-frame 22 (both shown in FIG. 1), so that the ink pipe 46 is pushed toward the ink port 86 via the sealing member 44. Alternatively, as shown in FIG. 11, a curing resin 88 (e.g. silicon-based adhesive which is resistant to ink) may be applied to the opposite sides of the ink port 86 in the shape of a slope, thereby contacting the sealing member 44 to the ink port 86 more intimately and preventing ink leakage more reliably.

With the foregoing arrangement, ink can be supplied to the ink port 86 via the ink pipe 46 without passing through the main frame 14. This reliably prevents erosion of the main frame 14 by ink and deterioration of the ink quality. Further, the ink pipe 46 is in pressure-contact with the ink port 86 via the sealing member 44, which enables ink to be sealed from the main frame 14 and enhances prevention of the ink leakage.

Figure 12:
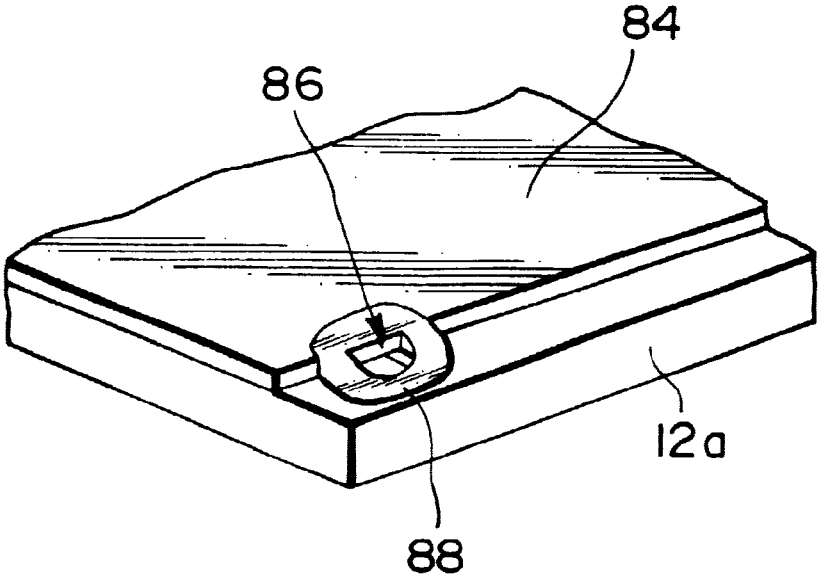
FIG. 12 shows a modified example in which the ink conduit plate and the diaphragm are joined in the fourth embodiment.

The curing resin 88 may be applied around the ink port 86 in the annular shape as shown in FIG. 12 as an alternative measure. In this case, the ink pipe 46 can be connected to the ink port 86 in an optimum manner without using the sealing member 44. The curing resin 88 preferably has elasticity which is equal to or greater than that of the sealing member 44.

Figure 10:
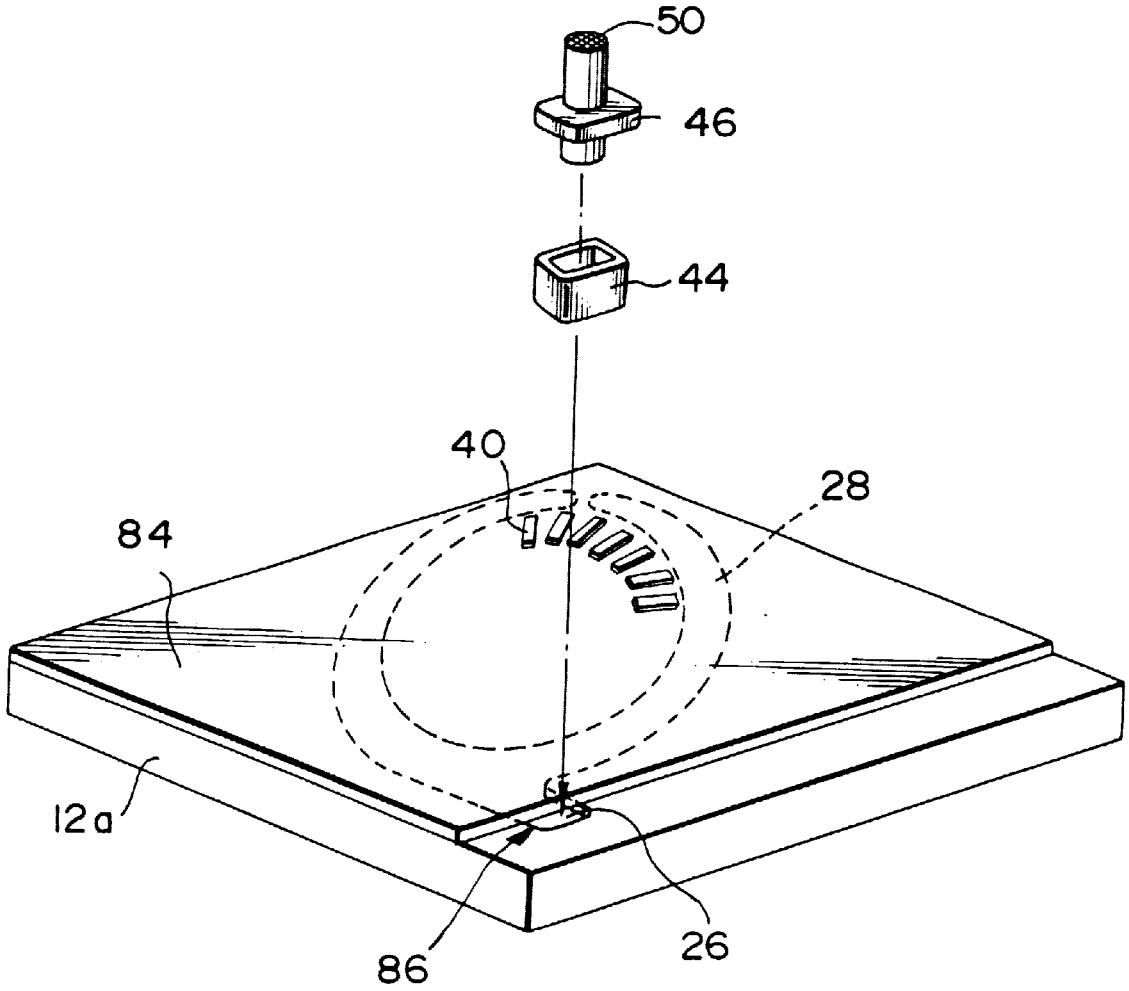
FIG. 10 is a view showing an ink port and an ink pipe in an inkjet printing head according to a fourth embodiment.

A filter 50 is fused to the ink pipe 46 on a side adjacent to the ink reservoir 20 as shown in FIG. 10. Alternatively, the filter 50 may be placed on the curing resin 88 and stuck together with the curing resin 88. In this case, the inkjet printing head 10 can be assembled without the sealing member 44 and filter 50 included therein. Thus, it is possible to provide a tubular projection on the ink reservoir 20, and connect this projection directly to the head assembly 12. This is advantageous in that the number of components and the number of assembling processes can be reduced.

What is claimed is:

1. An ink jet printing head comprising:

a head assembly, including:

an ink conduit plate, pressure chambers arrayed on the ink conduit plate, each pressure chamber having an ink inlet at a first end of the pressure chamber and a nozzle at a second end of the pressure chamber, an ink conduit connected to the ink inlet of each pressure chamber, a diaphragm disposed over and covering an end of each pressure chamber, and a plurality of piezoelectric elements attached to the diaphragm in one-to-one correspondence with the pressure chambers, wherein each piezoelectric element is operable to move a portion of the diaphragm to vary a capacity of a pressure chamber corresponding to the piezoelectric element to draw ink through the ink inlet and to expel ink through the nozzle;

the ink jet printing head further comprising:

a main frame having a first surface that supports the head assembly, a second surface, and a hollow portion that is oval in shape at a center of the main frame;

a flexible cable that is oval in shape and positioned in the hollow portion of the main frame, the flexible cable including a group of electrodes for applying a drive voltage to the piezoelectric elements;

a flexible member that is oval in shape and adjacent to the second surface of the main frame, the flexible member keeping the piezoelectric elements and the flexible cable in mutual contact within the hollow portion of the main frame and preventing the flexible cable from resonating due to movement of the piezoelectric elements; and a sub-frame positioned to apply pressures to secure the flexible cable and the flexible member to the main frame.

2. The ink jet printing head as in claim 1, wherein the main frame includes a recess for receiving the head assembly, and the hollow portion of the main frame is shaped similarly to the flexible cable so to house the flexible cable therein.

3. The ink jet printing head as in claim 2, wherein the nozzle of each pressure chamber is inclined with respect to a printing line with a predetermined angle on the head assembly and the flexible cable is housed in the hollow portion.

4. The ink jet printing head as in claim 1, wherein the sub-frame has a rimmed window that is oval in shape and is sized and shaped to fit into the hollow portion of the main frame, and the rimmed window supports the flexible member.

5. The ink jet printing head as in claim 2, wherein the sub-frame has a rimmed window that is sized and shaped to fit into the hollow portion of the main frame, and the rimmed window supports the flexible member.

6. The ink jet printing head as in claim 3, wherein the sub-frame has a rimmed window that is sized and shaped to fit into the hollow portion of the main frame, and the rimmed window supports the flexible member.

7. The ink jet printing head of claim 1, wherein the diaphragm includes an ink port for supplying ink to the ink conduit, the print head further comprising an ink pipe that is connected to an ink supply and is disposed close to the ink port.

8. The ink jet printing head of claim 1, further comprising an ink introducing portion, an ink supply and an ink supply pipe, wherein the diaphragm is smaller than the ink conduit plate so as to have the ink introducing portion of the ink conduit exposed from the diaphragm and positioned to form an ink port, and wherein the ink supply pipe is connected to the ink supply and is positioned close to the ink port.

9. The ink jet printing head as in claim 8, wherein the ink port is joined to the ink supply pipe by a flexible sealing member.

10. The ink jet printing head as in claim 8, wherein a curing resin is applied to a step portion between the ink conduit plate and the diaphragm so as to form a sloped structure on opposite sides of the ink port.

11. The ink jet printing head as in claim 9, wherein a curing resin is applied to a step portion between the ink conduit plate and the diaphragm so as to form a sloped structure on opposite sides of the ink port.

12. The ink jet printing head as in claim 10, wherein a curing resin is applied in an annular shape to a peripheral area of the ink port.

13. The ink jet printing head as in claim 11, wherein a curing resin is applied in an annular shape to a peripheral area of the ink port.

14. The ink jet printing head as in claim 12, further comprising a filter closely attached by the curing resin to the ink port so as to filter impurities in the ink.

15. The ink jet printing head as in claim 13, further comprising a filter closely attached by the curing resin to the ink port so as to filter impurities in the ink.

16. The ink jet printing head of claim 1, further comprising a driver IC attached on the flexible cable so as to perform central control of the piezoelectric elements.

17. The ink jet printing head as in claim 16, wherein the flexible cable having the driver IC is held in place by contact pressure between the main frame and the sub-frame.

18. The ink jet printing head as in claim 17, wherein the flexible cable includes an external connection terminal for receiving a driver-IC-operating signal at the other end thereof.

19. The ink jet printing head as in claim 17, wherein the second surface of the main frame includes a recess for housing the driver IC.

20. The ink jet printing he ad as in claim 17, wherein a surface of the sub-frame that is abutted to the main frame includes a recess for housing the driver IC.

* * * * *